US011976392B2

(12) United States Patent
Pearce

(10) Patent No.: US 11,976,392 B2
(45) Date of Patent: May 7, 2024

(54) CUSHION COVER WITH INTEGRALLY KNIT, HIGH-RELIEF GRAPHIC FEATURE AND CUSHIONS EMPLOYING SUCH CUSHION COVERS

(71) Applicant: Purple Innovation, LLC, Alpine, UT (US)

(72) Inventor: Tony M. Pearce, Alpine, UT (US)

(73) Assignee: Purple Innovation, LLC, Lehi, UT (US)

( * ) Notice: Subject to any disclaimer, the term of this patent is extended or adjusted under 35 U.S.C. 154(b) by 737 days.

(21) Appl. No.: 15/063,143

(22) Filed: Mar. 7, 2016

(65) Prior Publication Data

US 2017/0254003 A1 Sep. 7, 2017

(51) Int. Cl.
*D04B 1/12* (2006.01)
*D04B 1/02* (2006.01)

(52) U.S. Cl.
CPC ..... *D04B 1/126* (2013.01); *D04B 1/02* (2013.01); *D10B 2503/062* (2013.01); *D10B 2505/08* (2013.01)

(58) Field of Classification Search
None
See application file for complete search history.

(56) References Cited

U.S. PATENT DOCUMENTS 3,180,681 A * 4/1965 Buralli ..... B60N 2/60 297/224
4,369,284 A 1/1983 Chen
5,213,863 A 5/1993 Day et al.
5,618,082 A * 4/1997 Jachmich ..... A47C 31/11 297/219.1
5,749,111 A 5/1998 Pearce
5,994,450 A 11/1999 Pearce
6,026,527 A * 2/2000 Pearce ..... A43B 13/04 428/137
6,321,574 B1 * 11/2001 Marker ..... D04B 9/12 66/19
6,865,759 B2 3/2005 Pearce
7,076,822 B2 7/2006 Pearce
7,484,256 B2 2/2009 Murphy et al.
(Continued)

FOREIGN PATENT DOCUMENTS

BE 1019490 A3 7/2012
CN 1062500 A 7/1992
(Continued)

OTHER PUBLICATIONS

European Patent Office, "Supplementary European Search Report," for U.S. Appl. No. 17/763,799, dated Jul. 2, 2019.
(Continued)

*Primary Examiner* — Shawn Mckinnon
(74) *Attorney, Agent, or Firm* — DENTONS Durham Jones Pinegar

(57) ABSTRACT

A cushion cover includes a one-piece knit fabric configured to at least partially surround a cushion, the cover including at least one graphic feature protruding from an associated surrounding area of the one-piece knit fabric. The at least one graphic feature is integrally knitted in the one-piece knit fabric and has a thickness at least about 2 times the thickness of the associated surrounding area of the one-piece knit fabric.

20 Claims, 2 Drawing Sheets

(56) References Cited

U.S. PATENT DOCUMENTS

| | | | | |
|---|---|---|---|---|
| 7,730,566 | B2 | 6/2010 | Flick et al. | |
| 7,823,233 | B2 | 11/2010 | Flick et al. | |
| 7,827,636 | B2 | 11/2010 | Flick et al. | |
| 7,964,664 | B2 | 6/2011 | Pearce | |
| 8,075,981 | B2 | 12/2011 | Pearce et al. | |
| 8,075,987 | B2 | 12/2011 | Pearce et al. | |
| 8,434,748 | B1 * | 5/2013 | Pearce | B68G 5/00 267/142 |
| 8,607,387 | B2 | 12/2013 | Flick et al. | |
| 8,628,067 | B2 | 1/2014 | Pearce et al. | |
| 8,769,743 | B2 | 7/2014 | Sanders | |
| 8,784,982 | B2 | 7/2014 | Pearce et al. | |
| 8,919,750 | B2 | 12/2014 | Pearce et al. | |
| 8,932,692 | B2 | 1/2015 | Pearce | |
| 9,314,059 | B2 | 4/2016 | Kanayama | |
| 2005/0076446 | A1 * | 4/2005 | Fogg | A47C 27/148 5/690 |
| 2005/0172406 | A1 * | 8/2005 | Post | A61G 7/0504 5/626 |
| 2006/0135014 | A1 | 6/2006 | Murphy et al. | |
| 2007/0017028 | A1 * | 1/2007 | Myers | A47G 9/0246 5/497 |
| 2013/0167302 | A1 | 7/2013 | Pearce | |
| 2015/0104604 | A1 | 4/2015 | Rock et al. | |

FOREIGN PATENT DOCUMENTS

| | | | |
|---|---|---|---|
| CN | 1103117 | A | 5/1995 |
| CN | 1160785 | A | 10/1997 |
| CN | 102733057 | A | 10/2012 |
| CN | 103230189 | A | 8/2013 |
| CN | 203735543 | U | 7/2014 |
| CN | 204764641 | U | 11/2015 |
| DE | 69202367 | T2 | 9/1995 |
| DE | 202013105666 | U1 | 1/2014 |
| EP | 0501809 | A1 | 9/1992 |
| EP | 1975294 | A1 | 10/2008 |
| EP | 2042629 | A1 | 4/2009 |
| EP | 2717747 | A1 | 4/2014 |
| JP | S38-008561 | Y | 5/1963 |
| JP | S51-110816 | A | 9/1976 |
| JP | 2001-514912 | A | 9/2001 |
| JP | 2003-183957 | A | 7/2003 |
| JP | 2004033522 | A | 2/2004 |
| JP | 2004-097540 | A | 4/2004 |
| JP | 2008284163 | A | 11/2008 |
| JP | 2014028501 | A | 2/2014 |
| KR | 200462482 | Y1 | 9/2012 |
| WO | 99/08571 | A1 | 2/1999 |
| WO | 2012173970 | A1 | 12/2012 |
| WO | 2015150981 | A1 | 10/2015 |

OTHER PUBLICATIONS

Korean Patent Office, "Reasons for Rejection," Korean patent application No. 10-2018-7028894, dated Sep. 20, 2019.

Japanese Patent Office, "Reason for Rejection," Japanese patent application No. 2018-545846, dated Nov. 25, 2019.

Innovation in Textiles, "Warp-knitted spacer fabrics for a good nights sleep," https://www.innovationintextiles.com/warp-knitted-spacer-fabrics-for-a-good-nights-sleep/, Feb. 22, 2011.

European Patent Office, "Search Report," European patent application No. 17763799.8, dated May 5, 2020.

Chinese National Intellectual Property Administration, "First Office Action," Chinese Application No. 201780016005.5, dated Jun. 11, 2020.

Japan Patent Office, "Decision of Rejection," Japanese Application No. 2018-545841, dated Jul. 10, 2020.

Canadian Intellectual Property Office, "Examiner's Report," Canadian Application No. 3016707, dated Jun. 21, 2019.

IP Australia, "Examination Report No. 1," Australian Application No. 2017228991, dated Nov. 27, 2018.

IP Australia, "Examination Report No. 2," Australian Application No. 2017228991, dated Feb. 21, 2019.

Korean Intellectual Property Office, "Notice of Allowance," Korean Application No. 10-2018-7028894, dated Mar. 18, 2020.

Japan Patent Office, "Notice of Reasons for Rejection," Japanese Application No. 2018-545841, dated Nov. 20, 2019.

Taiwan Intellectual Property Office, "First Office Action," Taiwan Application No. 106107012, dated Sep. 17, 2020.

Chinese National Intellectual Property Administration, "Second Office Action," Chinese Application No. 2017800160055, dated Apr. 9, 2021.

International Search Report for PCT Application No. PCT/US2017/020781 dated May 29, 2017, 3 pages.

Written Opinion of International Searching Authority for PCT Application No. PCT/US2017/020781 dated May 29, 2017, 11 pages.

* cited by examiner

CUSHION COVER WITH INTEGRALLY KNIT, HIGH-RELIEF GRAPHIC FEATURE AND CUSHIONS EMPLOYING SUCH CUSHION COVERS

TECHNICAL FIELD

Embodiments of the present disclosure relate generally to cushion covers and, more particularly, to cushion covers having a one-piece knit fabric with large-scale, high-relief graphic features.

BACKGROUND

Cushioning materials have a variety of uses, such as for mattresses, mattress toppers, seating surfaces, shoe inserts, packaging, medical devices, etc. Cushioning materials may be formulated and/or configured to reduce peak pressure on a cushioned body, which may increase comfort for humans or animals, and may protect objects from damage. Cushioning materials may be formed of materials that deflect or deform under a load. Cushion covers enclosing such cushioning materials are preferably suited to not detract from the cushioning properties of the cushioning materials enclosed therein.

Cushion covers may be provided with graphic features for assistance with, among other things, branding and marketing. For example, typical logos found on mattress covers may be in a size range of about 2 inches×3 inches, totaling about 6 square inches. Common types of graphic features employed on cushion covers include embroidery, sewn-on labels and thermal transfers. However, embroidery, sewn-on labels and thermal transfers can be rigid, detracting from the cushioning performance of the cushioning materials enclosed within the cover, and may also increase in cost with increasing size, which costs become multiplied with each additional embroidery, sewn-on label and thermal transfer applied to a cushion cover.

BRIEF SUMMARY

In one embodiment of the disclosure, a cushion cover includes a one-piece knit fabric configured to at least partially surround a cushion and at least one graphic feature protruding from an associated surrounding area of the one-piece knit fabric. The at least one graphic feature is integrally knitted in the one-piece knit fabric and has a thickness at least about 2 times the thickness of the associated surrounding area of the one-piece knit fabric.

In another embodiment of the disclosure, a cushion includes a cushion cover that includes a one-piece knit fabric at least partially surrounding a cushion material. The cushion material substantially fills a volume of the one-piece knit fabric. The cushion also includes at least one graphic feature protruding from an associated surrounding area of the one-piece knit fabric. The at least one graphic feature is integrally knitted in the one-piece knit fabric and has a thickness at least about 2 times the thickness of the associated surrounding area of the one-piece knit fabric.

BRIEF DESCRIPTION OF THE DRAWINGS

While the specification concludes with claims particularly pointing out and distinctly claiming what are regarded as embodiments of the present disclosure, various features and advantages of disclosed embodiments may be more readily ascertained from the following description when read with reference to the accompanying drawings, in which:

DETAILED DESCRIPTION

The illustrations presented herein are not actual views of any particular cushion, cushion cover, fabric or graphic feature, but are merely idealized representations employed to describe embodiments of the present disclosure. Additionally, elements common between figures may retain the same numerical designation.

Figure 1:
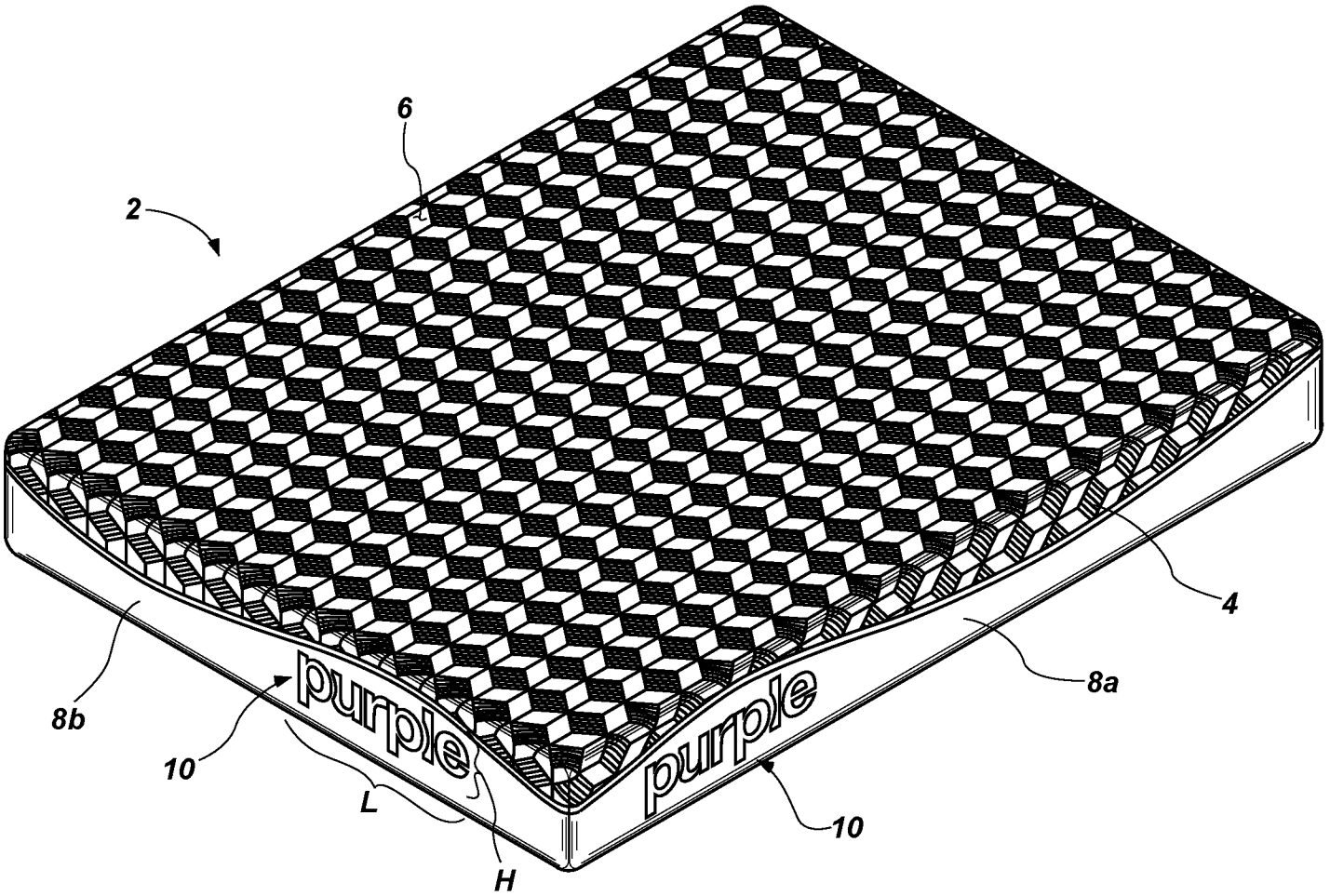
FIG. 1 illustrates a perspective view of a cushion cover enclosing a cushion therein, according to an embodiment of the present disclosure.

FIG. 1 is perspective view of a cushion cover 2 enclosing a cushion therein. The cushion and the cushion cover 2 may be a mattress and a mattress cover, as shown in FIG. 1, although other types of cushions are within the scope of the present disclosure, including mattress toppers, seat cushions, pillows and upholstery cushions, by way of non-limiting example. Furthermore, while the cushion cover 2 and the cushion therein may each be in a shape of a cuboid, other cushion and cover shapes are also within the scope of the disclosed embodiments.

The cushion cover 2 may include a one-piece knit fabric 4 at least partially enclosing the cushion therein. For example, when the cushion cover 2 is formed to at least partially enclose a cuboid cushion, such as a mattress, the one-piece knit fabric 4 may be a five-sided or full six-sided cover fabric having a primary cushioning face side 6 and four lateral sides 8*a*-8*d* each adjacent the primary cushioning face side 6 of the one-piece knit fabric 4. The four lateral sides 8*a*-8*d* may include a first lateral side 8*a*, a second lateral side 8*b*, a third lateral side 8*c*, and a fourth lateral side 8*d* (only the first and second lateral sides 8*a* and 8*b* are visible in FIG. 1). The third lateral side 8*c* may be located opposite the first lateral side 8*a* and the fourth lateral side 8*d* may be located opposite the second lateral side 8*b*. In embodiments where the one-piece knit fabric 4 is a full six-sided one-piece knit fabric 4, the only secondary sewing on the one-piece knit fabric 4 may be at the edges or corners between various sides of the fabric to close the edges or corners. In embodiments where the one-piece knit fabric 4 is a five-sided one-piece knit fabric 4, the only secondary sewing on the one-piece knit fabric 4 may be at the edges or corners between the lateral sides 8*a*-8*d* to close the edges or corners thereof. The one-piece knit fabric 4 may be knit such that each of the sides thereof exhibits a favorable degree of elasticity to enhance the cushioning effect and/or sensation of the cushion and the cushion cover 2 during use.

The primary cushioning face side 6 of the one-piece knit fabric 4 may be configured to contact, support, cushion, and otherwise receive in a cushioning manner a body or object thereon. When the cushion cover 2 is a mattress cover, the first and third lateral sides 8*a*, 8*c* of the one-piece knit fabric 4 may correspond to the relatively longer lateral "sides" of the mattress while the second and fourth lateral sides 8*b*, 8*d* of the one-piece knit fabric 4 may correspond to the relatively shorter lateral "ends" of the mattress. For a "twin"-sized mattress cover, the first and third lateral sides 8*a*, 8*c* of the one-piece knit fabric 4 may each have a length of about 75 inches and the second and fourth lateral sides 8*b*, 8*d* may each have a length of about 39 inches. For a "full"-sized mattress cover, the first and third sides 8*a*, 8*c* of the one-piece knit fabric 4 may each have a length of about 75 inches and the second and fourth sides 8*b*, 8*d* may each have a length of about 54 inches. For a "queen"-sized mattress cover, the first and third sides 8*a*, 8*c* of the one-piece knit fabric 4 may each have a length of about 80 inches and the second and fourth sides 8*b*, 8*d* may each have a length of about 60 inches. For a "king"-sized mattress cover, the first and third sides 8*a*, 8*c* of the one-piece knit fabric 4 may each have a length of about 80 inches and the second and fourth sides 8*b*, 8*d* may each have a length of about 76 inches.

The cushion cover 2 may include at least one graphic feature 10 on one or more of the primary cushioning face side 6 and the four lateral sides 8*a*-8*d* of the one-piece knit fabric 4. The graphic feature 10 may include one or more of a logo, a symbol, a figure, a character, text, a name or clip art or the like, as opposed to a repeating decorative pattern. The at least one graphic feature 10 may be integrally knitted in the one-piece knit fabric 4 using a machine knitting process, such as a circular knitting process, a flat knitting process, or other knitting process. The at least one graphic feature 10 may be integrally knitted into the one-piece knit fabric 4 during the same process as the entire remainder of the one-piece knit fabric 4. Because the at least one graphic feature 10 may be integrally knit into the one-piece knit fabric 4, no secondary process or component may be necessary to provide the at least one graphic feature 10 on the one-piece knit fabric 4.

The at least one graphic feature 10 may be integrally knitted into any of the sides of the one-piece knit fabric 4. As shown in FIG. 1, graphic features 10 may be integrally knitted into at least the first lateral side 8*a* and the second lateral side 8*b* of the one-piece knit fabric 4. While not visible in FIG. 1, additional graphic features 10 may also be integrally knitted into the second and fourth lateral sides 8*b*, 8*d* of the one-piece knit fabric 4. In other embodiments, an additional graphic feature 10 may also be integrally knitted into the primary cushioning face side 6 of the one-piece knit fabric 4. It is to be appreciated that different graphic features 10 may be integrally knitted into various portions of the one-piece knit fabric 4.

Figure 2:
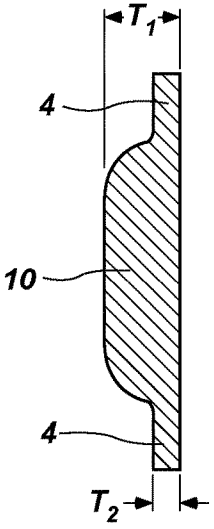
FIG. 2 illustrates a partial cross-sectional view of a cushion cover and a graphic feature integrally knitted therein, according to an embodiment of the present disclosure.

The graphic feature 10 may be what is termed a "high-relief" feature, meaning the graphic feature 10 may have a maximum thickness $T_1$ at least two (2) times greater than a thickness $T_2$ of fabric in an area of the one-piece knit fabric 4 at least partially surrounding the graphic feature 10, as shown in FIG. 2. In this manner, the graphic feature 10 may protrude from the surrounding area of the one-piece knit fabric 4 in a visible manner. The thickness $T_1$ of the graphic feature 10 relative to the thickness $T_2$ of the surrounding fabric may allow the graphic feature 10 to be perceived by a consumer without the need for providing the graphic feature 10 with a color different than the surrounding fabric. It is to be appreciated, however, that the graphic feature 10 may be provided with a color different than that of the surrounding fabric to enhance visual recognition of the graphic feature 10. In further embodiments, the graphic feature 10 may have a maximum thickness $T_1$ at least three (3) times greater than the thickness $T_2$ of the surrounding fabric of the one-piece knit fabric 4. By way of non-limiting example, the graphic feature 10 may have a maximum thickness $T_1$ of about 0.1 inch or greater and the surrounding area of the one-piece knit fabric 4 may generally have a thickness $T_2$ of about 0.05 inch, such as at the tie downs. As an additional example, the graphic feature 10 may have a maximum thickness $T_1$ of about 0.15 inch or greater and the surrounding area of the one-piece knit fabric 4 may generally have a thickness $T_2$ of about 0.05 inch at the tie downs. As a yet additional example, the surrounding area of the one-piece knit fabric 4 may generally have a thickness $T_2$ of about 0.08 inch and the graphic feature 10 may have a maximum thickness $T_1$ of about 0.16 inch or greater. As a further example, the surrounding area of the one-piece knit fabric 4 may generally have a thickness $T_2$ of about 0.08 inch and the graphic feature 10 may have a maximum thickness $T_1$ of about 0.24 inch or greater. As a yet further example, the surrounding area of the one-piece knit fabric 4 may generally have a thickness $T_2$ of about 0.1 inch and the graphic feature 10 may have a maximum thickness $T_1$ of about 0.3 inch or greater.

The graphic feature 10 may also be what is termed a "large-scale" feature, meaning that the largest dimension of the graphic feature 10 may be at least about 10% of the largest dimension of the side of the one-piece knit fabric 4 in which the graphic feature 10 is knitted. For example, in embodiments where the cushion cover 2 is a queen-sized mattress cover with the graphic feature 10 integrally knit into the first side 8*a* and/or the third side 8*c* (the first side 8*a* and the third side 8*c* each having a length of about 80 inches), the graphic feature 10 may have an overall length L and/or an overall height H of at least about 8 inches. In further such embodiments, the graphic feature 10 may have a length L of at least about 16 inches and a height H of at least about 5 inches. Similarly, if the graphic feature 10 is located on the second side 8*b* and/or the fourth side 8*d* of the one-piece knit fabric 4 (the second side 8*b* and the fourth side 8*d* each having a length of about 60 inches), the graphic feature 10 thereon may have an overall length L or overall height H of at least about 6 inches. In further such embodiments, the graphic feature 10 may have a length L of at least about 16 inches and a height H of at least about 5 inches. Moreover, if the graphic feature 10 is integrally knitted into the primary cushioning face side 6 of the one-piece knit fabric 4 (having a major length of about 80 inches and a minor length of about 60 inches), the graphic feature 10 thereon may have an overall length L or overall height H of at least about 8 inches. When graphic features 10 are integrally knitted into multiple sides of the one-piece knit fabric 4, the graphic features 10 may each be the same size or sized differently. In further embodiments, the largest dimension of the graphic feature 10 may be at least about 25% of the largest dimension of the side of the one-piece knit fabric 4 in which the graphic feature 10 is integrally knitted.

As set forth above, the graphic feature 10 may be integrally knitted with the same constituent fabric material as the remainder of the fabric of the one-piece knit fabric 4; accordingly, the graphic feature 10 may be the same color as the remainder of the one-piece knit fabric 4 (i.e., the entire one-piece knit fabric 4 may be the same color). Such a configuration allows the graphic feature 10 to be visible and "stand out" without "shouting" or otherwise being overly conspicuous. By way of non-limiting example, the entire one-piece knit fabric 4 may be white, off-white, light gray, dark gray, black or light violet in color. Other colors for the one-piece knit fabric 4 are also within the scope of the present disclosure.

It is to be appreciated that because the graphic features 10 may be integrally knitted into the one-piece knit fabric 4 during the same process as the remainder of the fabric of the one-piece knit fabric 4, there may be minimal, if any, added cost for providing the graphic features 10 on the one-piece knit fabric 4. Accordingly, cushion covers 2 may be provided with larger graphic features 10 and a greater number of graphic features 10, adding to the visual effect and marketing potential of the cushion covers 2, without adding to the cost of producing the cushion covers 2. For example, increasing the size of a single rectangular embroidery graphic feature on a mattress cover from 2 inches×3 inches (total area of 6 square inches) to 8 inches×12 inches (total area of 96 square inches), while maintaining a stitch per square inch count, would require 16 times as many stitches. Because embroidery costs may be directly calculated by stitch count, an 8 inches×12 inches rectangular embroidery graphic feature may cost as many as 16 times as much as a 2 inches×3 inches rectangular graphic feature. In contrast, because the graphic features 10 of the present disclosure are integrally knitted into the one-piece fabric 4 during the same knitting process and the remainder of the one-piece knit fabric 4, an 8 inches×12 inches graphic feature 10 may be provided on the cushion cover 2 for substantially the same cost as a 2 inches×3 inches graphic feature 10. Furthermore, a multiplicity of graphic features 10 of relatively larger size may be integrally knitted into the one-piece knit fabric 4 for substantially the same cost as knitting a one-piece knit fabric without any graphic features. For example, large-scale, high-relief graphic features 10 may be integrally knitted onto each of the four side surfaces 8*a*-8*d* and the primary cushioning face side 6 of the one-piece knit fabric 4 substantially without increasing the cost of the cushion cover 2. Additionally, the thickness of the graphic features 10 disclosed herein may also be increased substantially without increasing the cost of the one-piece knit fabric 4. Accordingly, one may see that the integrally knitted graphic features 10 disclosed herein offer significant cost savings over prior art graphic features. Thus, cushion covers 2 according to the embodiments disclosed herein may include more, larger, and thicker graphic features 10 substantially without increasing the production cost of the cushion cover 2 and while providing significant aesthetic, branding and marketing advantages over prior art cushion covers.

Additionally, because the graphic features 10 disclosed herein are integrally knitted into the one-piece knit fabric 4 of the cushion cover 2, the graphic features 10 may exhibit an elasticity comparable to an elasticity of the remainder of the one-piece knit fabric 4, allowing a graphic feature 10 to be provided on the primary cushioning face side 6 of the one-piece knit fabric 4 without deleteriously affecting the cushioning feel and quality of the cushion. Thus, when the cushion cover 2 is a cover for a mattress or a seat cushion, a person may lay or sit, respectively, on the covered mattress or seat without experiencing discomfort caused by a rigid graphic feature on the primary cushioning face side 6 of the one-piece knit fabric 4. Embroidered graphic features are rather rigid and uncomfortable to sit or lie upon. Thermal transfers, while typically not as rigid as embroidery features, are nevertheless rigid and uncomfortable to sit or lie upon. Sewn-on labels become increasingly rigid with increasing thickness, and thus may be untenable for inclusion on the primary cushioning face side 6 of the one-piece knit fabric 4. Additionally, sewn-on labels may crease or wrinkle responsive to compression experienced by a covered cushion during shipping, packaging and/or storage.

Figure 3:
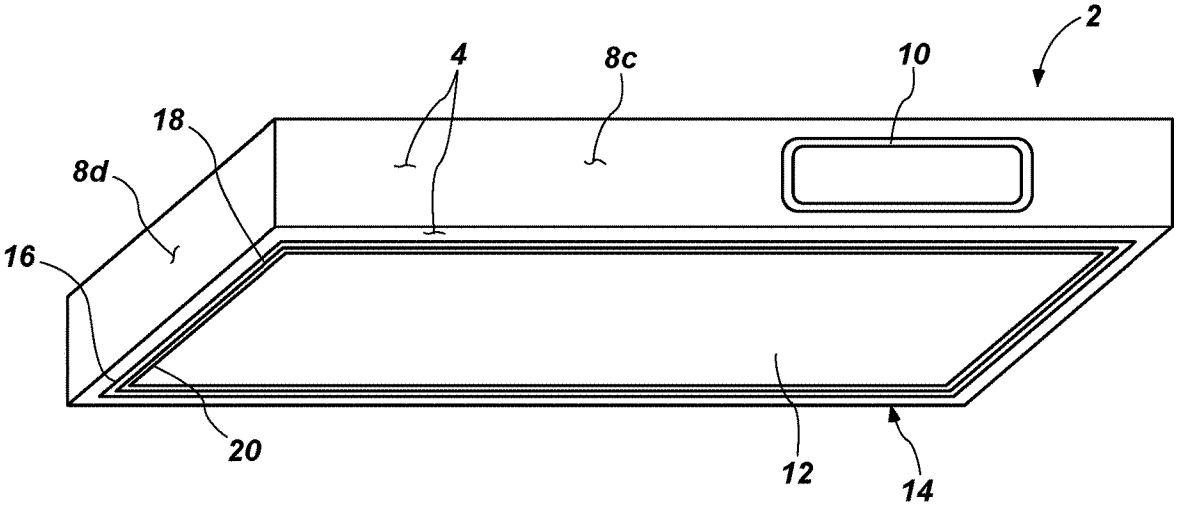
FIG. 3 illustrates a perspective view of cushion cover having a one-piece knit fabric with five sides and a base material coupled to the bottom of the one-piece knit fabric, according to an embodiment of the present disclosure.

FIG. 3 is a perspective view of an embodiment of the cushion cover 2 covering a cushion, the cushion cover 2 having a one-piece knit fabric 4 with five (5) sides and a base material 12 coupled to the bottom of the one-piece knit fabric 4 and effectively forming the sixth, bottom side 14 of the cushion cover 2. As disclosed previously, the one-piece knit fabric 4 may have one or more graphic features 10 integrally knitted therein. In this embodiment, the one-piece knit fabric 4 may extend beyond the four lateral sides 8*a*-8*d* and partially onto the bottom side 14 of the cushion cover 2 a distance of about 2 inches. A first zipper tape 16 may be sewn onto the edges of the one-piece knit fabric 4 located on the bottom side 14 of the cushion cover 2. In this embodiment, the only secondary sewing on the one-piece knit fabric 4 may be to close the edges or corners between the four lateral sides 8*a*-8*d* and to install the first zipper tape 16 on the one-piece knit fabric 4. The base material 12 on the bottom side 14 of the cushion cover 2 may be configured to be generally planar when the cushion cover 2 is fitted over and enclosing a correspondingly sized cushion therein. The base material 12 may comprise a material that is more rigid than the one-piece knit fabric 4 and which may optionally be a non-skid material. Peripheral edges 18 of the base material 12 may have a second zipper tape 20 attached thereto and configured to matingly engage the first zipper tape 16 to form a zipper unit allowing repeated attachment and removal of the base material 12 and the one-piece knit fabric 4 and insertion of cushion material into the cushion cover 2.

A five-sided one-piece knit fabric 4, as shown in FIG. 3, or a six-sided one-piece knit fabric, discussed above, are beneficial because they allow a user to more fully "sink" into the cushion material, particularly, for example, when the cushion material is a memory polyurethane foam or a hollow-column buckling gel or a latex foamed rubber or a conventional polyurethane foam. The cushioning effect is enhanced by the one-piece knit fabric 4 including the lateral sides 8*a*-8*d*, which may also "give way" and/or stretch when a user is laying or sitting on the cushion. As previously described, because the graphic features 10 are integrally knitted into the one-piece knit fabric 4, the graphic features 10 may exhibit an elasticity comparable to that of the remainder of the one-piece knit fabric 4, which allows numerous, large-scale, high-relief graphic features 10 to be included in the cushion cover 2 substantially without decreasing the elasticity of the cushion cover 2 or compromising comfort of the cushioning material enclosed within the cushion cover 2. Additionally, knitting the one-piece knit fabric 4 in one piece may be less expensive and require fewer manufacturing steps than sewing separately woven or knitted pieces together.

Figure 4:
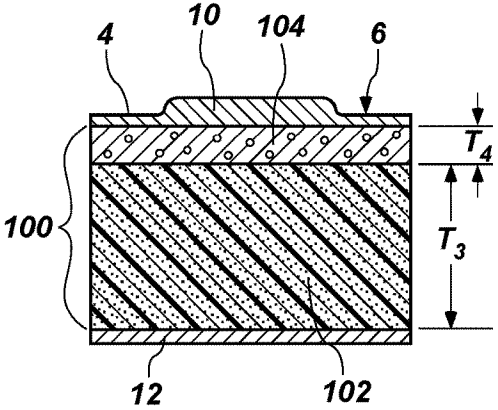
FIG. 4 illustrates a partial cross-sectional view of cushion material enclosed within a cushion cover, according to an embodiment of the present disclosure.

FIG. 4 is a partial cross-sectional view of the cushion cover 2 of FIG. 3 enclosing a mattress cushion 100. As previously described, the cushion cover 2 includes a five-sided one-piece knit fabric 4 attached to a base material 12 coupled to the bottom side of the one-piece knit fabric 4. A large-scale, high-relief, elastic graphic feature 10 may be integrally knitted on the primary cushioning face side 6 of the one-piece knit fabric 4. The mattress cushion 100 may include a layer of foam 102 atop the base material 12 of the cushion cover 2 and a layer of hollow-column buckling gel 104 atop the layer of foam 102. By way of non-limiting example, the layer of foam 102 may have a thickness $T_3$ between about 6 inches and about 10 inches and the layer of hollow-column buckling gel 104 may have a thickness $T_4$ between about 1 inch and about 4 inches. In further embodiments, the layer of foam 102 may have a thickness $T_3$ of about 7.25 inches and the layer of hollow-column buckling gel 104 may have a thickness $T_4$ of about 2 inches.

Additional, nonlimiting embodiments within the scope of this disclosure include:

Embodiment 1: A cushion cover comprising: a one-piece knit fabric configured to at least partially surround a cushion; and at least one graphic feature protruding from an associated surrounding area of the one-piece knit fabric, the at least one graphic feature integrally knitted in the one-piece knit fabric, the at least one graphic feature having a thickness at least about 2 times the thickness of the associated surrounding area of the one-piece knit fabric.

Embodiment 2: The cushion cover of Embodiment 1, wherein the thickness of the at least one graphic feature is at least about 3 times thicker than the thickness of the associated surrounding area of the one-piece knit fabric.

Embodiment 3: The cushion cover of Embodiment 1 or Embodiment 2, wherein the graphic feature has a thickness of about 0.3 inch and the associated surrounding area of the one-piece knit fabric has a thickness of about 0.1 inch.

Embodiment 4: The cushion cover of any one of Embodiments 1 through 3, wherein the graphic feature is integrally knitted in the one-piece knit fabric in the same process as an entire remainder of the one-piece knit fabric.

Embodiment 5: The cushion cover of any one of Embodiments 1 through 4, wherein the graphic feature is circularly knitted in the one-piece knit fabric.

Embodiment 6: The cushion cover of any one of Embodiments 1 through 5, wherein the cushion cover further comprises at least five sides of the one-piece knit fabric collectively configured to be in the shape of a cuboid when the cushion cover is filled with a cushion, the at least five sides of the cushion cover include a primary cushioning side and four lateral sides of the one-piece knit fabric, and the primary cushioning side is configured to contact and cushion an object received on the cushion cover when the cushion cover is filled with a cushion.

Embodiment 7: The cushion cover of Embodiment 6, wherein the at least one graphic feature comprises at least two graphic features each located on separate sides of the five sides of the one-piece knit fabric.

Embodiment 8: The cushion cover of Embodiment 6 or Embodiment 7, wherein the at least one graphic feature is located on the primary cushioning side of the one-piece knit fabric.

Embodiment 9: The cushion cover of any one of Embodiments 6 through 8, wherein the at least one graphic feature comprises at least four graphic features located on the four lateral sides of the one-piece knit fabric.

Embodiment 10: The cushion cover of any one of Embodiments 6 through 9, wherein each of the at least five sides of the one-piece knit fabric is elastic.

Embodiment 11: The cushion cover of any one of Embodiments 6 through 10, further comprising: a base material comprising a sixth side of the one-piece knit fabric, the base material being more rigid than the one-piece knit fabric, the base material joined to the four adjacent sides of the one-piece knit fabric by a zipper traversing edges between the base material and the four adjacent sides of the one-piece knit fabric; and cushion material disposed within the one-piece knit fabric and substantially filling an internal volume of the one-piece knit fabric and the base material.

Embodiment 12: The cushion cover of Embodiment 11, wherein the cushion material comprises: a layer of foam having a thickness between about 6 inches and 10 inches; and a layer of hollow-column buckling gel supported by the layer of foam and having a thickness between about 1 inch and 4 inches.

Embodiment 13: The cushion cover of any one of Embodiments 1 through 12, wherein a greater of a width and height of the at least one graphic feature is at least 10 percent of a greater of a width and height of a side of the one-piece knit fabric on which the at least one graphic feature is knitted.

Embodiment 14: The cushion cover of any one of Embodiments 1 through 13, wherein a greater of a width and height of the at least one graphic feature is at least 25 percent of a greater of a width and height of a side of the one-piece knit fabric on which the at least one graphic feature is knitted.

Embodiment 15: The cushion cover of any one of Embodiments 1 through 14, wherein the graphic features has a width of at least 16 inches and a height of at least 5 inches.

Embodiment 16: The cushion cover of any one of Embodiments 1 through 15, wherein the graphic feature is elastic.

Embodiment 17: The cushion cover of any one of Embodiments 1 through 16, wherein the one-piece knit fabric is a mattress cover or mattress topper cover configured to at least partially surround a mattress or mattress topper.

Embodiment 18: The cushion cover of any one of Embodiments 1 through 17, wherein the at least one graphic feature is the same color as an entire remainder of the one-piece knit fabric.

Embodiment 19: The cushion cover of any one of Embodiments 1 through 18, wherein the cushion cover further comprises at least six sides of the one-piece knit fabric collectively configured to be enclosed in the shape of a cuboid when the cushion cover is filled with a cushion.

Embodiment 20: A cushion, comprising: a cushion cover, including: a one-piece knit fabric at least partially surrounding a cushion material, the cushion material substantially filling a volume of the one-piece knit fabric; and at least one graphic feature protruding from an associated surrounding area of the one-piece knit fabric, the at least one graphic feature integrally knitted in the one-piece knit fabric, the at least one graphic feature having a thickness at least about twice the thickness of the associated surrounding area of the one-piece knit fabric.

Although the foregoing description contains many specifics, these are not to be construed as limiting the scope of the present disclosure, but merely as providing certain exemplary embodiments. Similarly, other embodiments of the disclosure may be devised that do not depart from the spirit or scope of the present disclosure. For example, features described herein with reference to one embodiment also may be provided in others of the embodiments described herein. The scope of the disclosure is, therefore, indicated and limited only by the appended claims and their legal equivalents, rather than by the foregoing description. All additions, deletions, and modifications to the disclosed embodiments, which fall within the meaning and scope of the claims, are encompassed by the present disclosure.

What is claimed is:

1. A cushion, comprising:

a cushioning element comprising a hollow-column buckling gel defining at least part of an interior of the cushion; and a cover on the cushioning element, defining an exterior of the cushion, and comprising:

a one-piece knit fabric that covers a top surface and lateral surfaces of the cushioning element and has an elasticity that enhances a cushioning effect and/or a sensation of the cushioning element and enables a user to sink into the cushioning element; and at least one graphic feature integrally knitted in the one-piece knit fabric, having a thickness at least about two times a thickness of an associated surrounding area of the one-piece knit fabric and having a same elasticity as the elasticity of the one-piece knit fabric, the at least one graphic feature comprising a same material as a remainder of the one-piece knit fabric, wherein the cover further comprises at least six sides wherein one of the at least six sides is a base side, the base side comprising a base material joined to four lateral sides of the one-piece knit fabric by a zipper traversing edges between the base material and the four lateral sides of the one-piece knit fabric;

wherein the zipper is positioned entirely on the base side; and wherein the base material is more rigid than the one-piece knit fabric.

2. The cushion of claim 1, wherein the thickness of the at least one graphic feature is at least about three times thicker than the thickness of the associated surrounding area of the one-piece knit fabric.

3. The cushion of claim 2, wherein the at least one graphic feature has a thickness of about 0.3 inch and the associated surrounding area of the one-piece knit fabric has a thickness of about 0.1 inch.

4. The cushion of claim 1, wherein the at least one graphic feature is circularly knitted in the one-piece knit fabric.

5. The cushion of claim 1, wherein the one-piece knit fabric is in a shape of a cuboid when the cover is filled with the cushioning element, the at least six sides of the cover include a primary cushioning portion and four lateral sides of the one-piece knit fabric, and the primary cushioning side is configured to contact and cushion an object received on the cushion cover when the cushion cover is filled with the cushioning element.

6. The cushion of claim 5, wherein the at least one graphic feature comprises at least two graphic features located on separate sides of the cushioning element.

7. The cushion of claim 5, wherein the at least one graphic feature is located on the primary cushioning portion of the one-piece knit fabric.

8. The cushion of claim 5, wherein the at least one graphic feature comprises at least four graphic features located on the four lateral sides of the one-piece knit fabric.

9. The cushion of claim 5, wherein an entirety of the one-piece knit fabric is elastic.

10. The cushion of claim 1, wherein the cushioning element further comprises:

a layer of at least one of a polyurethane foam, a memory polyurethane foam, or a latex foamed rubber superimposed with the hollow-column buckling gel.

11. The cushion of claim 1, wherein a greater of a width and height of the at least one graphic feature is at least 25 percent of a greater of a width and height of a side of the one-piece knit fabric on which the at least one graphic feature is knitted.

12. The cushion of claim 1, wherein the at least one graphic feature has a width of at least 16 inches and a height of at least 5 inches.

13. The cushion of claim 1, wherein the cushioning element comprises a mattress cover or a mattress topper.

14. The cushion of claim 1, wherein the one-piece knit fabric completely encloses the cushioning element.

15. A cushion, comprising:

a cushioning element comprising at least part of an interior of the cushion and comprising a cushion material comprising a hollow-column buckling gel; and a cushion cover comprising an exterior of the cushion, the cushion cover including:

a one-piece knit fabric completely covering a top and sides of the cushion material, the cushion material substantially filling a volume of the one-piece knit fabric, the one-piece knit fabric having an elasticity that enables the one-piece knit fabric to deform with a corresponding surface of the cushion material as the corresponding surface is deformed, enhances a cushioning effect and/or a sensation of the cushion material, and enables a user to sink into the cushion material; and at least one graphic feature integrally knitted in the one-piece knit fabric, the at least one graphic feature having a thickness at least about twice a thickness of an associated surrounding area of the one-piece knit fabric, the at least one graphic feature having an elasticity the same as the elasticity of the one-piece knit fabric, enabling the at least one graphic feature to stretch without deleteriously affecting a cushioning feel and quality of the cushion material, wherein the at least one graphic feature is comprised of a same material as a remainder of the one-piece knit fabric, wherein a greater of a width and height of the at least one graphic feature is at least 10 percent of a greater of a width and height of a side of the one-piece knit fabric on which the at least one graphic feature is knitted; and a base material joined to the one-piece knit fabric to cover a base of the cushioning element, the base material engaging four lateral sides of the one-piece knit fabric, wherein the base material is more rigid than the one-piece knit fabric.

16. The cushion of claim 1, wherein the one-piece knit fabric does not define a seam around a periphery of the top surface of the cushion.

17. The cushion of claim 1, wherein the at least one graphic feature has a same color as the remainder of the one-piece knit fabric.

18. The cushion of claim 1, wherein the cushioning element comprises a mattress.

19. The cushion of claim 15, wherein the one-piece knit fabric does not define a seam around a periphery of a top surface of the cushion.

20. The cushion of claim 15, wherein the cushion material further comprises:

a layer of at least one of a polyurethane foam, a memory polyurethane foam, and a latex foamed rubber superimposed with the hollow-column buckling gel.

* * * * *